United States Patent [19]

Thompson et al.

[11] 4,085,865

[45] Apr. 25, 1978

[54] ELASTOMERIC BLADDER FOR POSITIVE EXPULSION TANK

[75] Inventors: Leo M. Thompson, Niagara Falls; Robert K. Anderson, Lockport; Lawrence H. Kocher, Tonawanda; John W. Jackel, Grand Island, all of N.Y.

[73] Assignee: Textron Inc., Providence, R.I.

[21] Appl. No.: 685,753

[22] Filed: May 13, 1976

[51] Int. Cl.[2] ..... B67D 5/54

[52] U.S. Cl. ..... 222/1; 222/386.5; 220/85 B

[58] Field of Search ..... 222/386.5, 214, 95, 222/1; 220/85 B; 150/.5

[56] References Cited

U.S. PATENT DOCUMENTS

| | | | |
|---|---|---|---|
| 3,234,737 | 2/1966 | Hiland | 222/386.5 X |
| 3,286,878 | 11/1966 | Schadt et al. | 220/85 B |
| 3,404,813 | 10/1968 | Waxman | 222/386.5 |
| 3,741,440 | 6/1973 | Sanders, Jr. | 222/132 |
| 3,809,291 | 5/1974 | Purdy | 222/386.5 X |
| 3,883,046 | 5/1975 | Thompson et al. | 222/386.5 |

FOREIGN PATENT DOCUMENTS

| | | | |
|---|---|---|---|
| 613,502 | 1/1961 | Canada | 222/95 |
| 597,491 | 8/1959 | Italy | 222/386.5 |

*Primary Examiner*—Robert B. Reeves
*Assistant Examiner*—Charles A. Marmor
*Attorney, Agent, or Firm*—Bean, Kauffman & Bean

[57] ABSTRACT

A method of storing a fluid product in a positive expulsion tank and subsequently expelling product therefrom, which prevents damage/failure of a resiliently deformable bladder, due to handling/transport forces exerted in the tank while exposed to a minimum design storage temperature.

The method includes the step of filling the product receiving cavity with the product at a filling temperature and at a volume at the filling temperature allowing the product to fill the product receiving cavity at the minimum design temperature while permitting the bladder to assume its as-fabricated configuration.

3 Claims, 6 Drawing Figures

ELASTOMERIC BLADDER FOR POSITIVE EXPULSION TANK

BACKGROUND OF THE INVENTION

In commonly assigned U.S. Pat. No. 3,883,046, there is disclosed an improved positive expulsion tank featuring a bladder having an as-fabricated tubular or cylindrical configuration. The bladder is end mounted within the tank on a centrally disposed assembly consisting of a pair of facing, axially spaced conically shaped members, which are apertured to permit the introduction and withdrawal of the product from within the confines of the bladder, and a product transport tube, which serves to connect the apexes of the members and may, if desired, also be apertured. The ends of the bladder are secured peripherally to the base of each of the conically shaped members, such that the bladder is essentially relaxed when it assumes its as-fabricated cylindrical configuration in which it is disposed concentrically outwardly of the transport tube. In this configuration of the bladder, it cooperates with the transport tube to define a partial tank-full cavity. When filling the tank, the liquid product introduced into the bladder will initially fill this cavity and then serve to expand the bladder outwardly until it assumes a highly tensioned, tank-full configuration.

The tank is emptied by applying an expelling fluid, such as a gas, to the tank exterior of the bladder. During resultant discharge of stored product through the transport tube, the bladder first returns to its essentially relaxed, as-fabricated cylindrical configuration and is thereafter again immediately tensioned as it is forced by the expelling fluid to assume a tank-empty configuration wherein it lies in conforming engagement with the surface of the transport tube. Thus, for each product discharge cycle, the bladder is exposed to two tension modes, during which the elastic properties of the bladder prevents the formation of failure producing uncontrolled buckles and folds. Further, the design as such that the bladder is not subject to abrading contract with any constraint or guide throughout substantially the whole of its range of deformation.

Since the filing of the patent application, which has now issued as above mentioned U.S. Pat. No. 3,883,046, the behavior of various bladder materials, while exposed to diverse propellants or fuels under a wide range of temperature storage conditions, have been the subject of intensive study. As a result, it has been determined that many product compatible bladder materials, which are capable of undergoing resilient deformation under normal and even relatively high temperature product storage conditions, are subject to becoming "set" or suffering a temporary loss of elastic memory or recovery ability after being maintained under relatively low temperature product storage conditions, as for instance about minus 65° F. When a product filled bladder becomes set in this manner, it has been found subject to permanent damage or complete failure, if forced to undergo a change in shape, such as would occur when the stored product experiences a high amplitude slosh mode resulting from sharp movements or accelerations of the expulsion tank during handling or transport thereof. Although the bladder materials under investigation have been found to be capable of eventually recovering their elastic memories after being returned to room temperature storage conditions for periods ranging from ten minutes to four hours or more, their low temperature-high stress failure characteristics have been found to place a practical limit on the versatility of positive expulsion tanks of a general type disclosed in the above-mentioned patent.

SUMMARY OF THE INVENTION

The present invention is directed towards improving the low temperature storage capabilities of positive expulsion tanks incorporating a bladder design of the general type disclosed in U.S. Pat. No. 3,883,046.

More specifically, the present invention is predicated on the observation that many bladder materials, which would be suitable for use in positive expulsion tanks of the type disclosed in the above-mentioned patent, except for the fact that they have unacceptable low temperature-stress failure characteristics, may be usefully employed if permitted to remain in a relatively low or untensioned state during prolonged periods when they are subjected to such relatively low storage temperatures. More specifically, it has been found that when these bladder materials are permitted to remain under relatively low stress conditions when subject to low storage temperatures, they are capable of withstanding without failure additional stress produced by movements or accelerations of the expulsion tank during handling or transport thereof.

In accordance with a preferred form of the present invention, the cross sectional areas of the bladder and tank are designed such that a bladder having an as-fabricated, essentially cylindrical configuration is permitted to assume such configuration under relatively untensioned or unstressed conditions, when the product receiving-storage cavity, as defined by the bladder and the tank or by the bladder and transport assembly, is filled with product maintained at some design, low storage temperature at which low temperature-stress failure characteristics of the bladder material are critical. Product may be discharged from the tank after elevation of the storage temperature to a value at which the bladder material regains its elastic memory by means of expulsion gas stored and/or subsequently introduced into a expulsion fluid cavity defined by the bladder and transport assembly or by the bladder and the tank; the bladder undergoing resilient deformation during the expulsion operation. The difference in volume between the volume of the tank and the design, low temperature capacity of the product receiving-storage cavity, that is the volume of an expulsion fluid cavity, would necessarily be sufficient to accommodate for expansion or increase in volume of the stored product resulting from an increase in product storage temperature up to some maximum design limit, and preferably to additionally accommodate for the presence of a charge of pressurized expulsion gas within the expulsion fluid cavity. Permissible product storage temperature variations may account for a growth in the volume of stored product of between about 6 and 8 percent.

In an alternative form of the present invention, a bladder is formed with a spheroidal as-fabricated configuration, which particularly adapts such bladder for use within generally spherical expulsion tanks.

The present invention additionally features modifications in the construction of product transport assemblies to accommodate for variations in size of the tank shell resulting from product temperature fluctuations for which the tank is designed.

DRAWINGS

The nature and mode of operation of the present invention will now be more fully described in the following detailed description taken with the accompanying drawings wherein.

Figure 5:
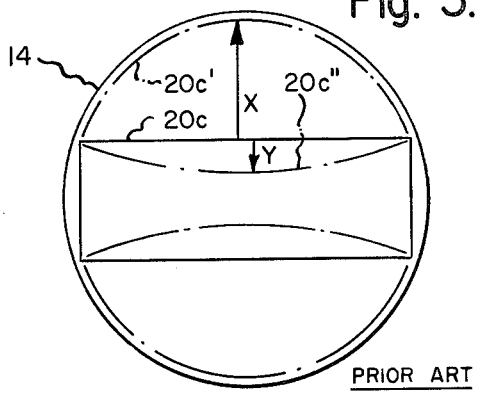
Figure 6:
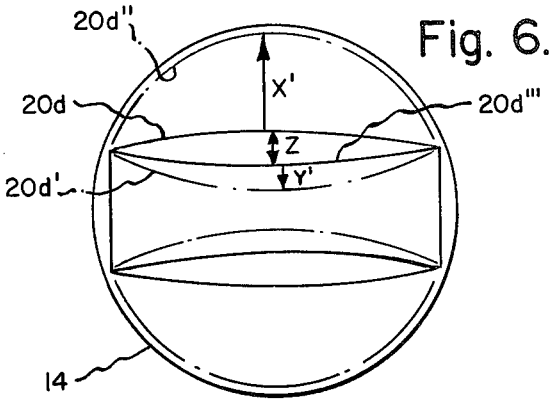
Figure 3:
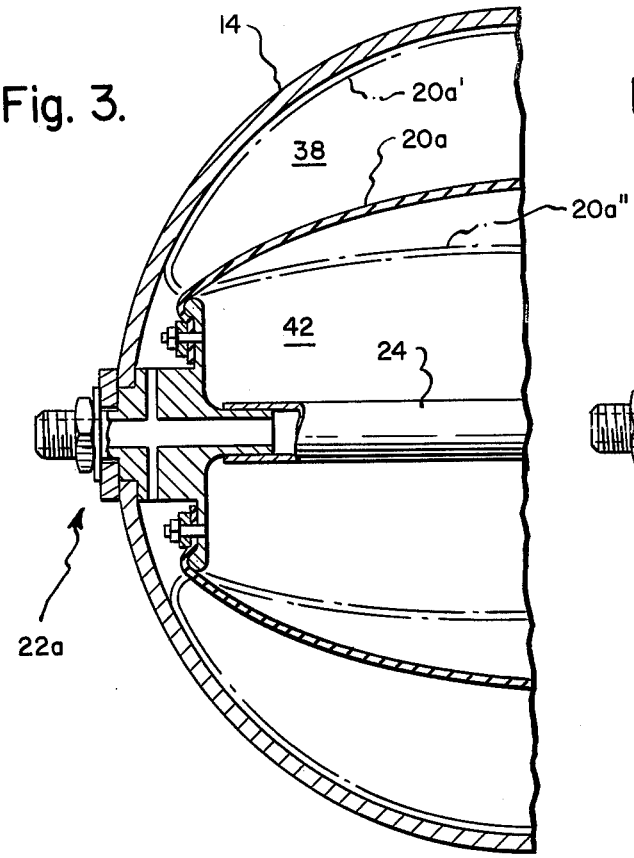
FIG. 3 is a fragmentary view similar to FIG. 1, but illustrating another alternative form of the present invention.
Figure 4:
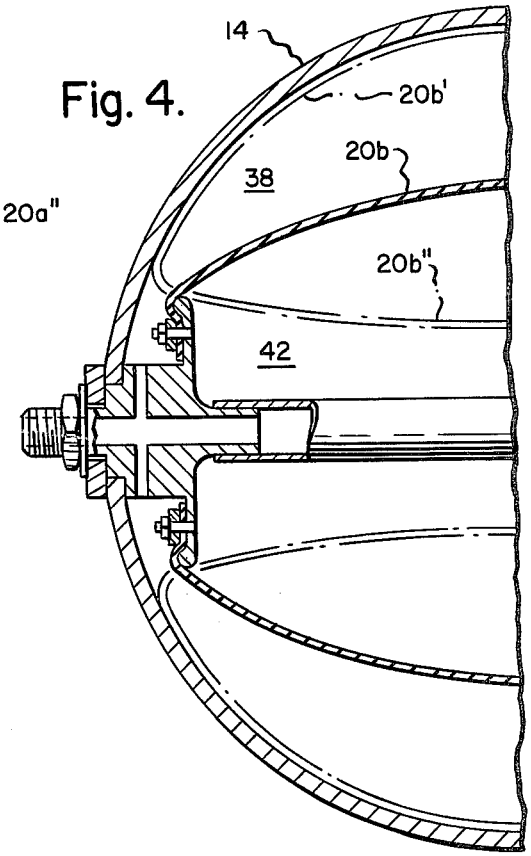

FIG. 4 is a view similar to FIG. 3, but illustrating a further alternative form of the present invention; and FIGS. 5 and 6 are diagrammatic views illustrating tank full and tank empty configurations of the cylindrical bladder employed in an expulsion tank disclosed in U.S. Pat. No. 3,883,046 and the spheroidal bladder shown in FIG. 4, respectively.

DETAILED DESCRIPTION

Figure 1:
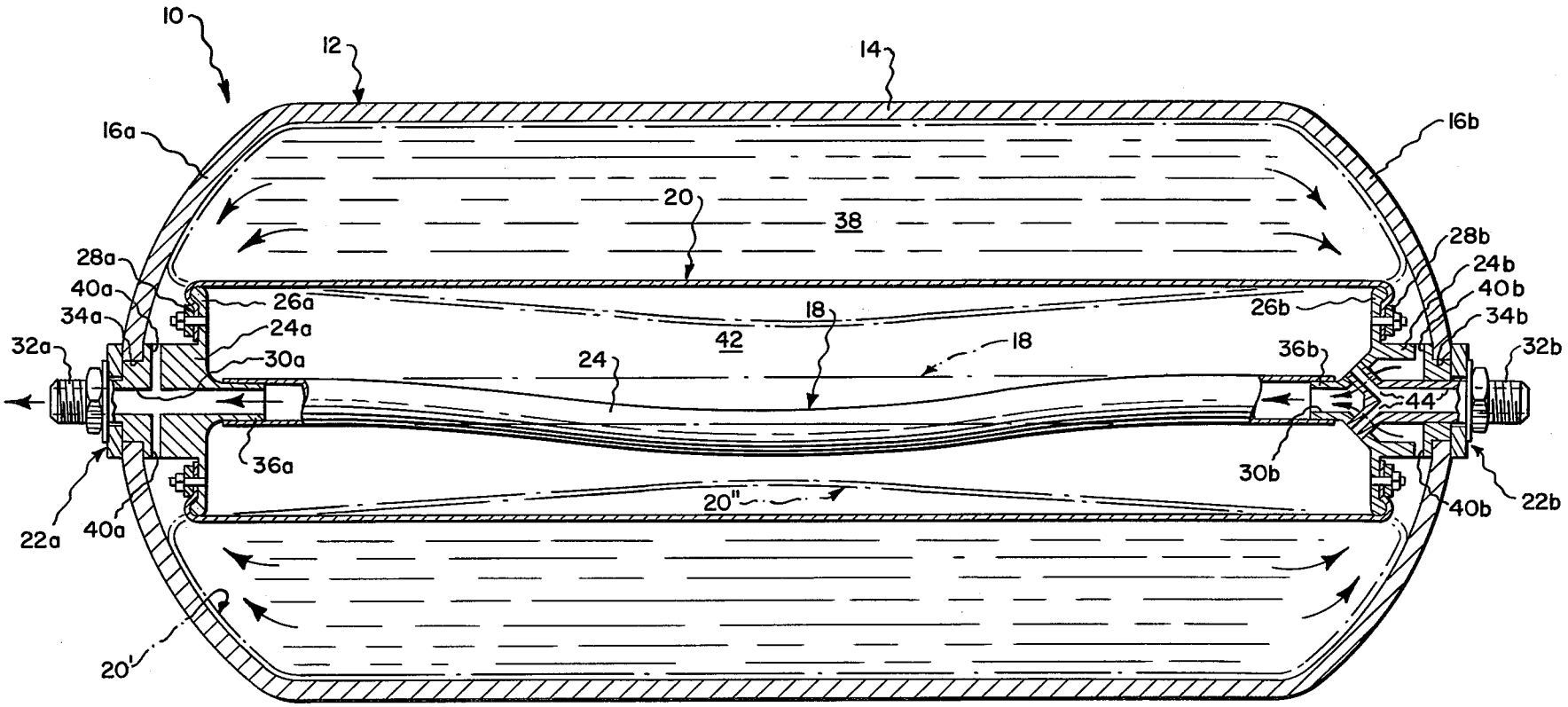
FIG. 1 is a partially sectionalized side elevational view of a generally cylindrical, positive expulsion tank incorporating the present invention.

A positive expulsion tank formed in accordance with a preferred form of the present invention is designated as 10 in FIG. 1. Tank 10 generally comprises a tank shell 12 having an essentially cylindrical central portion 14 and suitably contoured or rounded end portions 16*a* and 16*b;* a transfer tube assembly or device 18; and a bladder 20.

Transfer tube assembly 18 is shown in FIG. 1 as generally including a pair of mounting members 22*a*, 22*b* and a transfer tube 24. More specifically, in this form of the invention, mounting members 22*a*, 22*b* are formed with stepped diameter hub portions 24*a*, 24*b* and radially enlarged mounting rim portions 26*a*, 26*b*, which carry suitably mounting devices 28*a*, 28*b* for clamping supporting opposite ends of bladder 20 peripherally thereof. Hub portions 24*a*, 24*b* define product flow passageways 30*a*, 30*b* and have their oppositely disposed or outer ends 32*a*, 32*b* suitably clamped or fixed in fluid sealed relationship within opening 34*a*, 34*b* of tank end portions 16*a*, 16*b*. The adjacently disposed or inner ends 36*a*, 36*b* of hub portions 24*a*, 24*b* are suitably connected to the opposite ends of transfer tube 24.

With the arrangement illustrated in FIG. 1, bladder 20 cooperates with tank shell 12 to define a product receiving-storage cavity or chamber 38, which is placed in flow communication with passageways 30*a*, 30*b* and thus the opposite ends of transfer tube 24 by means of passages 40*a*, 40*b* opening radially through hub portions 24*a*, 24*b*. Passageway 30*a* opens to the exterior or tank shell 12 through end portion 32*a* for communication with a suitable valve controlled, product supply-discharge conduit, not shown. Bladder 20 also cooperates with transfer tube assembly 18 to define a product expansion accommodating-expelling fluid receiving cavity or chamber 42, which is arranged in flow communication with a suitable valve controlled, expelling fluid supply and/or discharge conduit, not shown, via a branched passageway 44 defined by mounting member 22*b*. In this form of the invention, transfer tube 24 is of a solid wall construction and fluid sealed to mounting member inner ends 36*a*, 36*b* in order to prevent communication between passageways 30*a*, 30*b* and chamber 42. Transfer tube 24 is, however, characterized as being sufficiently flexible, ie. resiliently deformable, so as to permit deformation thereof without failure between the relatively "bent" and "straight" configurations illustrated in full and broken lines in FIG. 1, as required to accommodate for variable spacing between mounting members 22*a* and 22*b* occasioned by pressure and/or thermally induced expansions and contractions of tank shell 12 incident to variations in product storage pressure and temperature.

In accordance with a preferred form of the present invention, bladder 20 is formed of a product compatible, resiliently deformable or elastomeric material, and has an as-fabricated tubular or cylindrical configuration. The material used in forming bladder 20 may also be characterized as having the disadvantage of tending to become "set" or being subject to a loss of elastic memory or recovery ability when maintained under a given or design low temperature storage condition, while at the same time being capable of undergoing acceptable degress of resilient deformation when maintained under middle and relatively high storage temperatures. For the bladder materials presently available for use in positive expulsion tanks, loss of elastic memory is temporary and may normally be recovered over periods of time ranging from 10 minutes to 4 hours or more after the materials have been returned to room temperature regardless of whether the bladder material is in an essentially relaxed or highly tensioned condition when "setting" occurs. However, while such materials remain in their "set" condition, they are subject to permanent damage or failure if they are forced to undergo a substantial change in shape, such as would occur during an expulsion operation, or even a relatively small change in shape, if this occurs when the bladder material is subjected to a relatively high tension condition. Of course, the bladder material employed in any given tank, as well as the relative sizes of cavities 38 and 42 at any given temperature will depend on the characteristics of the product to be stored and minimum and maximum storage temperatures for which the tank is designed.

As indicated in FIG. 1, mounting members 24*a*, 24*b* serve to mount bladder 20 centrally within the tank shell, such that it is unsupported intermediate its opposite ends and thus free of abrading contact with the tank shell and transfer tube assembly throughout substantially the whole of its range of deformation between its tank-full and tank-empty configurations to be hereinafter described.

In filling tank 10, product to be stored may be simultaneously introduced under pressure into both ends of cavity 38 via separate flow paths including passageway 30*a* and passages 40*a* and passageway 30*a*, transfer tube 24, passageway 30*b* and passages 40*b*, while branch conduit 44 remains blocked in order to permit pressurization of a previously introduced charge of expelling gas within cavity 42. The stored product may be subsequently expelled from both ends of cavity 38 by the pressure of the expelling gas within cavity 42 acting on bladder 20, whenever passageway 30*a* is unblocked, such as by placing same in flow communication with a rocket or jet engine in which the product is to be employed as a fuel and/or oxidizer. Alternatively, an external source of regulated expelling gas or liquid under pressure may be relied upon to effect product discharge expansion of the bladder when passageway 30*a* is unblocked.

Bladder 20 and tube 24 are shown in full line in FIG. 1 in the configurations they assume when the product retained in cavity 38 is at a temperature corresponding to the minimum design storage temperature of the tank, which may be for example −65° F. Of course, the minimum design storage temperature of the tank, that is, the minimum design temperature of the stored product, would normally not be below that point at which a particular stored product loses its fluid flow properties, in a like manner, the maximum design storage temperature of the tank or maximum design temperature of the stored product would normally not be above that point at which the stored product would change state, become unstable or become reactive with the materials forming the tank and bladder.

The present invention contemplates that bladder 20 will be allowed to assume its as-fabricated cylindrical configuration, shown in full line in FIG. 1, wherein it is relatively unstressed or subject to relatively low tension, whenever cavity 38 is filled with a product maintained at a minimum design storage temperature at which "setting" of the bladder material will occur, and cavity 42 is filled with a charge of pressurized expelling fluid, such as a gas which is preferably non-reactive with the stored product and the materials from which bladder 20 and assembly 18 are fabricated. As a practical matter, the configuration of bladder 20 may vary from that illustrated in FIG. 1, when tank 10 is turned on end or subjected to externally applied acceleration forces. However, any increase of tension in bladder 20 and/or change in shape thereof resulting from these factors will be sufficiently low so as to prevent failure thereof under minimum design temperature conditions.

In a preferred form of the invention, the charge of expelling gas is maintained under a pressure sufficient to effect expansion of the bladder into its "tank-empty" configuration shown in broken line and designated as 20' in FIG. 1, whenever passageway **30*a*** is unblocked.

It will be appreciated that the "tank full" configuration of bladder 20 will vary with tank storage temperature conditions in that the product stored within cavity 38 tends to expand as storage temperature increases above the minimum design value. Thus, in the preferred form of the present invention, the minimum design temperature capacity or volume of cavity 42 would be sufficient to accommodate for expansion of the stored product occasioned by increase in its temperature up to a maximum design storage temperature, which on the average will be between about 6 and 8 percent, and to allow for further compression of the expelling gas, which also tends to expand as storage temperature increases, without exceeding the internal pressure for which the tank is designed or rated.

As by way of example, the "tank full" configuration assumed by the bladder under a maximum design temperature storage condition is designated as 20'' in FIG. 1; the bladder having undergone an expansion from its as-fabricated configuration, which is occasioned by temperature-induced expansion of the stored product. Of course, the bladder will assume a shape intermediate those designated as 20 and 20'' when the tank is exposed to an intermediate range of storage temperature conditions, at which expulsion of the stored product may occur without damage/failure of the bladder. It will be appreciated that if passageway **30*a*** were to be unblocked, while the bladder is so extended, the expelling gas will first cause the bladder to return or contract to its as-fabricated cylindrical configuration and then cause the bladder to undergo expansion into its "tank empty" configuration. Thus, during the explusion operation, the bladder passes through two tension modes.

Since tank 12 also tends to expand or grow in a direction axially thereof as storage temperature increases, the spacing between mounting members **22*a*, 22*b* will also tend to increase. Accordingly, the bladder will not actually return to a fully relaxed state when temporarily returned to its as-fabricated cylindrical configuration, during discharge of stored product under intermediate or high temperature storage conditions. Although bladder 20** will normally be subject to tension and be deformed from its as-fabricated cylindrical configuration for all temperatures in excess of the minimum design storage temperature, the degree of tension to which the bladder will be exposed within the lower range of storage temperatures will be sufficiently low so as to avoid failure of the bladder material, which for most contemplated materials occurs only as a result of simultaneously occurring high tension-low temperature conditions.

A further advantage obtained by the practice of the present invention is that the minimum stress storage condition of bladder 20 serves to minimize the gas permeation rate of the system for any given bladder material.

The provision of a charge of pressurized gas within cavity 42 is preferred because the charge serves to both suppress vaporization of the stored product within cavity 38 and to accommodate for temperature induced expansion of the product.

It will be understood that the product to be stored may be introduced into chamber 38, while at any desired charging temperature at or intermediate its minimum and maximum design storage temperatures, providing that its volume at such charging temperature will permit bladder 20 to essentially assume its as-fabricated cylindrical configuration in the event that the tank storage temperature is subsequently reduced to the minimum design value. Further, while the illustrated tank construction is intended to store products in liquid form, it will be appreciated that the present invention is not limited thereto.

Figure 2:
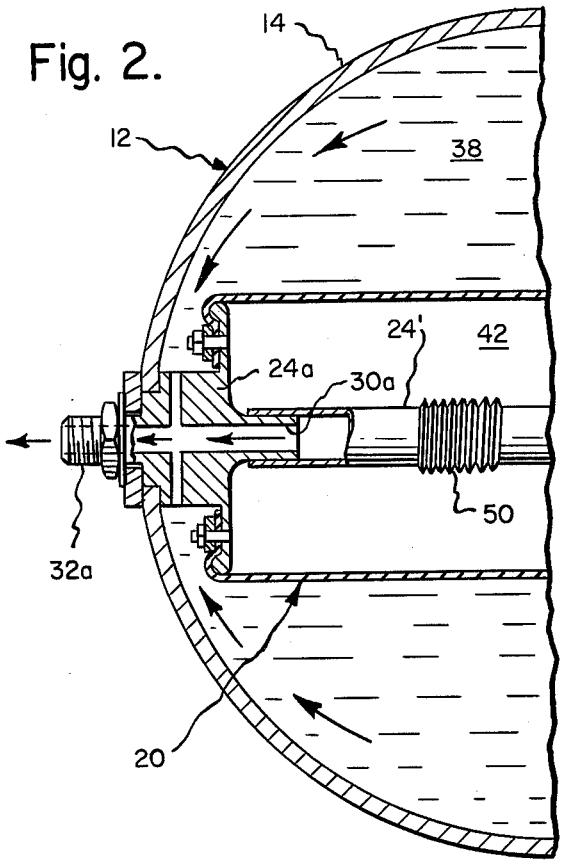
FIG. 2 is a fragmentary view similar to FIG. 1, but illustrating an alternative form of the present invention incorporated within a spherical expulsion tank.

Reference is now made to FIG. 2 for its showing of an alternative construction of the transfer tube, which possesses utility in an expulsion tank of the type previously described in reference to FIG. 1 and is generally designated as 24'. As with transfer tube 24, tube 24' is suitably sealed to mounting members **24*a*, 24*b* in order to isolate passagways 30*a*, 30*b* from cavity 42. However, in this construction tube 42' is formed with one or more flexible bellows segments or devices 50, which serve to accommodate for variations in spacing between the mounting members occasioned by thermally induced expansions and contractions of tank shell 12**.

FIG. 3 illustrates an alternative form of the present invention, wherein a bladder is provided with a spheroidal as-fabricated configuration and arranged within a generally spherical tank shell 14. It will be appreciated that the configuration assumed by the bladder for its low temperature tank full, tank empty and high temperature tank full conditions are designated as **20*a*, 20*a'* and 20*a''*, respectively. This construction also differs from that illustrated in FIG. 1** in that the bladder tends to assume its essentially relaxed, as-fabricated configuration under high temperature tank full conditions, such that it undergoes a slight expansion as storage temperature decreases with resultant reduction in volume of the stored product. However, the degree of tension present in the bladder when in its low temperature tank full configuration is insufficient to result in damage/failure thereof.

The spheroidal as-fabricated configuration of bladder 20a is particularly adapted for use in spherical expulsion tanks and for system employing bladder materials of limited elongation characteristics. In this respect, this bladder configuration serves to reduce the maximum biaxial stresses to which the bladder material is exposed under tank empty conditions and to minimize loss of product storage space adjacent the ends of the bladder, as compared to a like diameter, cylindrical as-fabricated bladder.

A further alternative embodiment illustrated in FIG. 4 is identical to that illustrated in FIG. 3, except that the low temperature tank full configuration designated at 20b is the as-fabrication bladder configuration and said tank empty and high temperature tank full configurations are designated as 20b' and 20b'', respectively. In effect, the high temperature tank full configuration of the bladder is an essentially inverted form of its spheroidal as-fabricated configuration. Thus, in this embodiment, the bladder is essentially free of stress intermediate to and at the minimum and maximum storage temperature conditions. As will be appreciated, this arrangement serves to increase the product storage capacity of the tank with minimal bladder stressing compared to the arrangement depicted in FIG. 3.

The bladder arrangement illustrated in FIG. 4 may also be used to advantage in an expulsion tank construction of the type disclosed in U.S. Pat. No. 3,883,046 when service requirements do not require low temperature storage conditions at which bladder materials become set. In this connection, reference is first made to FIG. 5 which illustrates a right cylinder as-fabricated bladder 20c, and its tank full and tank empty configurations, 20c' and 20c'', wherein it closely conforms to the tank shell and transport assembly, respectively; the bladder undergoing a radial expansion "$x$" between its as-fabricated and tank full configuration and a radial expansion "$y$" between its as-fabricated and tank empty configuration. For purposes of comparison, reference is now made to FIG. 6, while illustrates a spheroidal as-fabricated bladder 20d, and its tank empty and tank full configurations 20d' and 20d'', wherein it would normally closely conform to the transport assembly and tank shell, respectively. It will be noted that bladder position 20d''' in FIG. 6 corresponds to the inverted form of the bladder discussed above with reference to FIG. 4, such that the bladder is essentially free of stress intermediate to and at its 20d and 20d''' positions. Thus, for a given tank size and bladder end diameter, the bladder is required to undergo a radial expansion "$x'$" between its as-fabricated and tank full configurations and a radial expansion "$y'$" between its inverted and tank empty configurations, which are measurably less than the "$x$" and "$y$" expansions, respectively, required of a bladder of a cylindrical as-fabricated configuration. The difference between the total radial expansion of "$x + y$" and "$x' + y'$" corresponds to the deflection "$z$", which represents the relatively stress free radial expansion of the mid-point of the spheroidal bladder configuration as it translates between the as-fabricated and inverted configurations.

By like comparison, the same expansion/stress advantages accrue to as-fabricated bladder 20d as compared to as-fabricated bladder 20c, when product is stored in a cavity or chamber defined by the bladder and the tank shell in the manner described with reference to FIGS. 2-4.

Accordingly, the spheroidal arrangement is particularly advantageous when storage/operating requirements limit the selection of bladder materials to those having minimum elongation characteristics.

We claim:

1. A method of storing a fluid product in a positive expulsion tank and subsequently expelling said product from said tank by means of an expulsion fluid wherein the tank is to be subject to storage within a range of temperatures including a minimum design temperature and a maximum design temperature and is characterized as enclosing a bladder having an as-fabricated configuration and formed of a resiliently deformable material, which tends to become "set" when maintained under said minimum design temperature and is subject when "set" while in a relatively highly tensioned condition to damage/failure upon the application to said tank of handling/transport forces, said method including the steps of:

mounting said bladder within said tank to define a boundary between a product receiving cavity and an expulsion fluid receiving cavity which are disposed one relatively outwardly of said bladder and the other relatively inwardly of said bladder and which inversely vary in volume as said bladder is subjected to first and second tension modes, a first of said tension modes evolving an expansion of said bladder from said as-fabricated configuration to decrease the volume of said product receiving receiving to effect expulsion of product therefrom, the other of said tension modes evolving an expansion of said bladder from said as-fabricated configuration to decrease the volume of said expulsion fluid receiving cavity to accommodate for an increase in volume of said product within said product receiving cavity incident to an increase in temperature thereof between said minimum design temperature and said maximum design temperature;

filling said product receiving cavity with said product at a filling temperature disposed within said range of temperatures and at a volume at said filling temperature permitting said product to fill said product receiving cavity at said minimum design temperature while permitting said bladder to assume said as-fabricated configuration; and introducing said expulsion fluid into said expulsion fluid receiving cavity at least when said product is to be expelled from said product receiving cavity.

2. A method according to claim 1, including introducing said expulsion fluid in the form of a charge of pressurized expelling gas.

3. A method of storing a fluid product in a positive expulsion tank having a tank shell of essentially spherical configuration and subsequently expelling said product from said tank by means of an expulsion fluid wherein the tank is to be subject to storage within a range of temperatures including a minimum design temperature and a maximum design temperature and is characterized as enclosing a bladder having an as-fabricated configuration and formed of a resiliently deformable material, which tends to become "set" when maintained under said minimum design temperature and is subjected when "set" while in a relatively highly tensioned condition to damage/failure upon the application to said tank of handling/transport forces, said bladder defining a boundary between a product receiving cavity and an expulsion fluid receiving cavity, which are disposed outwardly and inwardly of said bladder, respectively, and which inversely vary in volume as said bladder moves relative to said shell, said method including the steps of:

forming said bladder with a spheroidal as-fabricated configuration;

mounting said bladder within said tank to define said boundary between said product receiving cavity and said expulsion fluid receiving cavity characterized in that said bladder is in an essentially relaxed condition when in said as-fabricated configuration and free of support intermediate opposite ends thereof to permit said bladder to deflect while remaining essentially free of stress to alternatively assume said as-fabricated configuration and an essentially inverted form of said as-fabricated configuration, said bladder being outwardly convex and outwardly concave when in said as-fabricated configuration and said inverted form respectively, said bladder being sized to permit deflection thereof between said as-fabricated configuration and said inverted form to accommodate for an increase in volume of said product within said product receiving cavity as defined by said bladder when in said as-fabricated configuration incident to an increase in temperature thereof between said minimum design temperature and said maximum design temperature;

filling said product receiving cavity with said product at a filling temperature disposed within said range of temperatures and at a volume at said filling temperature permitting said product to fill said product receiving cavity at said minimum design temperature while permitting said bladder to assume said as-fabricated configuration; and introducing said expulsion fluid in the form of a charge of pressurized gas into said expulsion fluid receiving cavity.

* * * * *

UNITED STATES PATENT AND TRADEMARK OFFICE

CERTIFICATE OF CORRECTION

PATENT NO. : 4,085,865

DATED : April 25, 1978

INVENTOR(S) : Leo M. Thompson et al

It is certified that error appears in the above-identified patent and that said Letters Patent are hereby corrected as shown below:

Col. 1, Line 40 - "as" should be --- is ---.

Col. 1, Line 41 - "contract" should be --- contact ---.

Col. 2, Line 43 - "a" should be --- an ---.

Col. 4, line 19 - "degress" should be --- degrees ---.

Col. 7, Line 43 - "while" should be --- which ---.

Claim 1, Lines 31 and 32 - The second occurrence of "receiving" should be --- cavity ---.

Signed and Sealed this

*Twelfth* Day of *September 1978*

[SEAL]

*Attest:*

RUTH C. MASON
*Attesting Officer*

DONALD W. BANNER
*Commissioner of Patents and Trademarks*